United States Patent [19]

Hetzel et al.

[11] Patent Number: 4,995,795

[45] Date of Patent: Feb. 26, 1991

[54] NOISE REDUCING WEAR SHIELD FOR PISTON FACE

[75] Inventors: Thomas Hetzel, Sheboygan; Roy J. Rozek, Plymouth, both of Wis.

[73] Assignee: Thomas Industries Incorporated, Louisville, Ky.

[21] Appl. No.: 413,596

[22] Filed: Sep. 28, 1989

[51] Int. Cl.[5] ..... F04B 21/02

[52] U.S. Cl. ..... 417/571; 417/562

[58] Field of Search ..... 137/904; 417/550, 562, 417/569, 571

[56] References Cited

U.S. PATENT DOCUMENTS

| | | | |
|---|---|---|---|
| 1,408,638 | 3/1922 | Prellwitz | 417/562 X |
| 1,883,328 | 10/1932 | Bihl et al. . | |
| 2,338,544 | 1/1944 | Scattoloni | 417/569 |
| 2,877,792 | 3/1959 | Tybus | 137/904 X |
| 2,963,217 | 12/1960 | Wysong, Jr. . | |
| 2,984,408 | 5/1961 | Nicholas | 417/562 |
| 3,606,588 | 9/1971 | Romerhaus . | |
| 3,961,868 | 6/1976 | Droege et al. . | |
| 4,275,999 | 6/1981 | Hetzel et al. . | |

*Primary Examiner*—Robert G. Nilson

*Attorney, Agent, or Firm*—Hill, Van Santen, Steadman & Simpson

[57] ABSTRACT

A wear shield attached to a piston in a piston type compressor cushioning impact and reducing friction between the piston and a valve which opens in a direction toward the piston. During some conditions of operation, without the wear shield, a piston can impact the opening valve, which opens interior of a cylinder which holds the piston. The wear shield installed between the piston and the opening valve reduces wear on the piston and on the valve, and also reduces operating noise.

18 Claims, 2 Drawing Sheets

NOISE REDUCING WEAR SHIELD FOR PISTON FACE

BACKGROUND OF THE INVENTION

The present invention relates to piston compressors, more particularly to a means of protecting a piston surface, and a head mounted valve of the piston compressor from wear due to repetitive contact between the two parts. Alternatively, when the compressor uses a piston mounted valve, the present invention provides a means of protecting a head surface and the valve from wear due to repetitive contact between the valve and the head. The present invention also acts to reduce operating noise of the subject compressor. Although the subject invention relates particularly to a wobble piston compressor, it can be applicable to any piston compressor.

A wobble piston compressor is known to the art. Such a machine using pistons and inlet and outlet reed valves or check valves is known.

U.S. Pat. No. 3,961,868 to Droege, Sr. et al, discloses a wobble piston compressor with a head, or head plate, mounted outlet check valve or reed valve, and an inlet reed valve mounted to a wobble piston; no wear plate is disclosed.

U.S. Pat. No. 4,275,999 to Hetzel et al discloses a wobble piston compressor similar to U.S. Pat. No. 3,961,868; no wear plate is disclosed.

A wobble piston compressor with the inlet valve located on the head is known.

One disadvantage of the wobble piston compressor with a head mounted inlet valve openable inwardly toward the piston, is the fact that during normal operation the inlet valve can make contact with the top surface of the piston causing wear to either or both parts. This can particularly happen when the piston cycle speed is slower than the valve opening speed or where the clearance between the cap of the piston and the undersurface of the head is small.

Under similar conditions, the same wearing effect can occur where the inlet valve is mounted to the wobble piston and opens inwardly toward the head. The valve can make repetitive contact with the head wearing the valve and the head.

The present invention provides a wear pad or wear shield which significantly reduces piston or head and valve wear. Another benefit of the wear shield is noise reduction during operation. In addition, the patch serves as a means of reducing premature failure of the flapper valve. It "cushions" the forces acting on the stainless steel strip.

SUMMARY OF THE INVENTION

It is an object of the present invention to provide a wear shield for a piston in a piston compressor which reduces or eliminates piston wear or head wear, and valve wear due to repetitive contacts between the valve and the piston, or the valve and the head; reduces operating noise level of the piston compressor; and can be easily and precisely installed.

The object is inventively accomplished in that a wear shield installed onto a piston or onto a head in the piston compressor opposite an opening valve, provides a cushioning of the impact between the piston or head and the valve during operation; the wear shield provides a smooth surface for reduced rubbing or friction contact between the piston or head and the valve; and the wear shield provides a relatively soft surface to reduce noise from impact between the piston or head and the valve.

Various embodiments provide for effective and precise means of attaching the wear shield to the piston or the head directly opposite the opening valve. The wear shield can be in tape form, can be secured by an adhesive, or can be partially captured between assemblable layers of the piston or the head. The wear shield can cover a small area of the piston face or head or the entire area of the piston face or head for ease of installation.

DESCRIPTION OF THE PREFERRED EMBODIMENTS

Although the present invention relates to a wobble piston compressor, it can be applicable to any piston, compressor and any such compressor is encompassed by the present invention.

Figure 1:
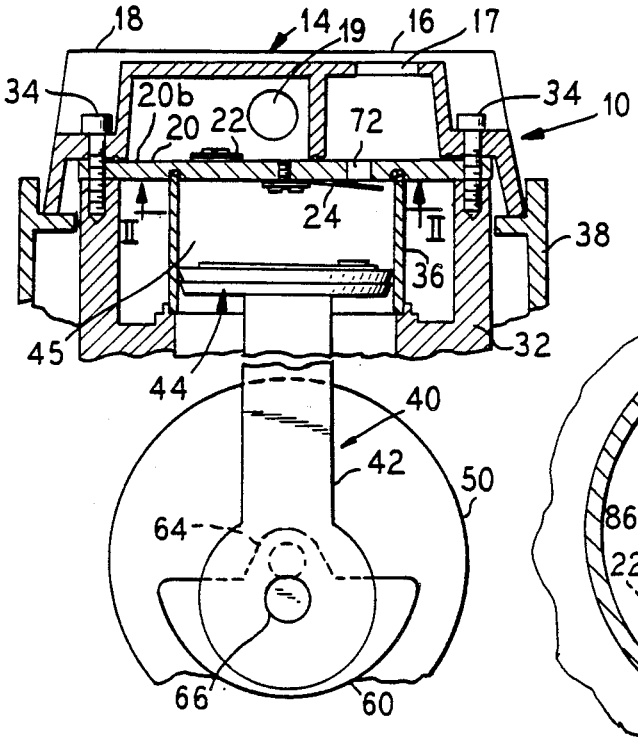
FIG. 1 is a partial sectional view through a wobble piston compressor.

FIG. 1 shows a wobble piston type compressor generally at 10. The compressor 10 includes on one end a manifold 14 including an inlet manifold 16 and an outlet manifold 18. Gas or air to be compressed enters an intake port 17 which opens the inlet manifold 16 to an air or gas source. Outlet manifold 18 includes an outlet port 19 for passing compressed air from the compressor 10. The manifold 14 is secured to a head 20. The head 20 comprises an outlet valve 22 and an inlet valve 24. The valves 22,24 can be reed valves as shown. The manifold 14 and the head 20 are secured together and to a block 32 by appropriate fasteners, such as a plurality of screws 34. The block 32 serves as superstructure and also holds a cylinder 36 tightly interior of a circular groove 21 formed into a lower surface **20*a* of the head 20. The surface 20*a* is on a side of the head 20 facing away from the manifold 14. The block 32 is surrounded by a casing 38**.

FIG. 1 also shows a piston assembly 40 which includes a rod 42 and a piston 44. The piston 44 resides interior of the cylinder 36 once assembled. The head 20, the cylinder 36 and the piston 44 form a generally enclosed volume 45. The rod 42 is connected to the piston 44. A flywheel 50 is rotated by an outside source such as a gas engine or an electric motor (not shown). The flywheel is connected at its axis to a counterweight 60 by a countershaft 64. The counterweight can comprise the shape of a semi-circle. Neither the flywheel 50 or the counterweight 60 are rotatable with respect to the countershaft 64. A crankshaft 66 connects the counterweight 60 to the rod 42; the crankshaft 66 is not rotatable with respect to the counterweight 60 but is rotatable with respect to the rod 42.

The general operation of the wobble piston compressor 10 is described in the following manner. The flywheel 50 is rotatably driven by an outside source (not shown). Such rotation imparts rotation to the counterweight 60 which causes orbital movement of the crankshaft 66 about the axis of the flywheel 50 because the crankshaft 66 is off-center from the axis of the flywheel 50. The orbital movement of the crankshaft 66 causes translational back and forth, or upstroke and downstroke, movement of the piston assembly 40. The piston 44 thus moves interior of the cylinder 36 in a direction toward and away from the head 20 along a central axis of the cylinder 36 during rotation of the flywheel 50. Since the piston assembly 40 has no wrist pin connecting the rod 42 and the piston 44, the piston 44 alternately tilts to the central axis of the cylinder 36 during upstroke and downstroke of the piston 44, causing a wobble during operation. This action is more precisely described in U.S. Pat. No. 3,961,868 to Droege Sr., et al. Movement by the piston 44 away from the head 20 opens the inlet valve 24 by suction and draws air into the cylinder 36 from the air source via the inlet manifold 16. When the piston then moves toward the head 20, the air drawn interior of the cylinder 36 is compressed, natural resiliency of the valve 24 and air pressure causes the inlet valve 24 to close, and such air pressure causes the outlet valve 22 to open, and air passes out of the cylinder 36 through the outlet valve 22. The pressurized air then exits the compressor 10 via the outlet manifold 18. When the cylinder then moves away from the head 20 the cycle is repeated as air is drawn into the cylinder 36 through the now reopened inlet valve 24.

Figure 2:
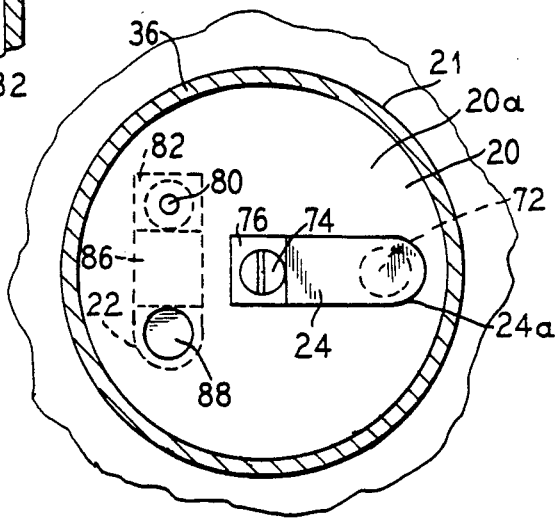
FIG. 2 is a sectional view generally along line II—II of FIG. 1.

FIG. 2 shows in greater detail the head 20. The inlet valve 24 is shown covering a hole 72 formed through the head 20. The hole 72 provides for passage of inlet air. The inlet valve 24 is connected to the head 20 by a screw 74 and a square washer 76. The inlet valve 24 comprises a flexible and resilient piece of metal. Other materials for the inlet valve 24 can be used which retain flexibility to be repeatedly opened and closed without cracking. The outlet valve is shown dashed, since it is positioned in the opposite side of the head 20. The outlet valve 22 can be constructed of similar materials as the inlet valve 24. The outlet valve 22 is secured to the head 20 on an opposite surface **20*b* (shown in FIG. 1) to the surface 20*a* by another screw 80, a square washer 82 and a flexible piece of plastic 86. The flexible piece of plastic 86 is used to assist in returning the valve 22 to a closed position. The outlet valve 22 covers a second hole 88 formed in the head 20 which provides passage of compressed air out of the compressor 10 via the outlet manifold 18. Also shown in FIG. 2 is the cylinder 36 fitting tightly interior of groove 21**, both having a circular shape.

Figure 3:
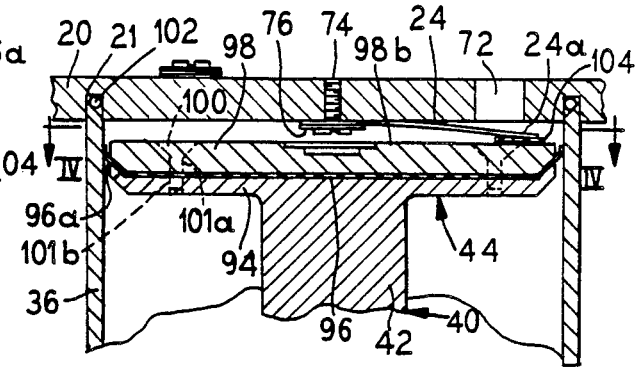
FIG. 3 is a fragmentary sectional view of a wobble piston compressor showing a piston in a nearly top dead center position.

The piston assembly 40 is shown at nearly top dead center position. FIG. 3 shows an enlarged view of the piston assembly 40. The piston 44 comprises a rod flange 94 which can be integral with the rod 42 as shown, or can be a separate piece connected to the rod 42. The rod flange 94 is generally circular and abuts, on a side nearest the head 20, a seal 96. The seal 96 is generally circular with a diameter somewhat greater than the rod flange 94. The seal 96 comprises an outer peripheral edge **96*a* turned toward the head 20. The outer peripheral edge 96*a* compresses slightly in diameter when the piston assembly 40 is inserted interior of the cylinder 36 during assembly. The function of the seal 96 is to guide the piston assembly 40 and to provide a sealed integrity of the cylinder 36, during translational movement and wobble movement of the piston assembly 40. The seal 96 is secured to the rod flange 94 by a cap 98. The cap 98 is circular with a diameter slightly smaller than the diameter of the seal 96. The cap 98 is secured to the rod flange 94 by appropriate fasteners, such as a plurality of cap screws 100. An appropriate number of aligned holes 101*a* to receive the screws 100 are provided in the cap 98 and the seal 96 Threaded holes 101*b* in the rod flange 94 receive the screws 100. The cap 98 provides a recessed portion 98*a* which permits the cap 98 to approach the head 20 closely without the cap 98 interfering with the screw 74 or the square washer 76. The cylinder 36 is shown residing interior of the groove 21 and compressing a sealing member or gasket 102. The gasket 102 provides for a sealed integrity of the cylinder 36 during operation. A wear shield 104 is shown attached to a surface 98*b* of cap 98, such surface 98*b* on a side closest to the head 20. The wear shield 104 is located directly facing an outward end portion 24*a* of the inlet valve 24. Without the wear shield 104, under certain operating circumstances, it is possible for the inlet valve 24 at the outward portion 24*a* to repeatedly interfere with the cap 98. This causes wear of both or either the inlet valve 24 or the cap 98. The wear shield 104 protects both the inlet valve 24 and the cap 98 by cushioning any impact between them and providing a smooth, friction-reduced surface to reduce wear between the parts. A reduction in operating noise is also anticipated. In the preferred embodiment the wear shield 104 is composed of a high molecular weight polyethylene and is secured by an adhesive. However, other materials are possible in this application. In the preferred embodiment the wear shield 104** is in the form of a piece of tape, thus incorporating its own adhesive, and providing simplicity of assembly.

Figure 4:
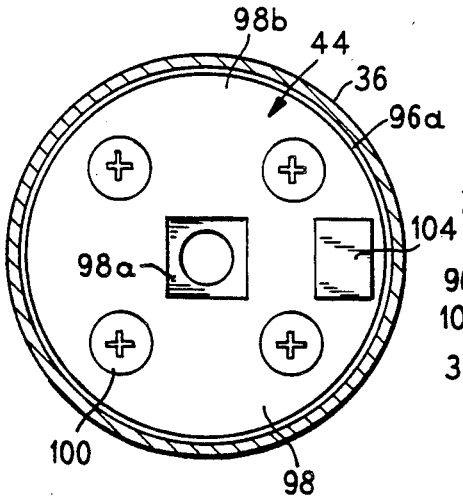
FIG. 4 is a sectional view generally along line IV—IV of FIG. 3.

FIG. 4 shows the cap 98, particularly the surface **98*b* facing interior of the cylinder 36. Four cap screws 100 are shown as well as the recessed portion 98*a*. The wear shield 104 is shown comprising a rectangular shape. It is within the scope of the present invention to provide a wear shield of any size and configuration, including a covering of the entire surface 98*b*** of the cap.

Figure 5:
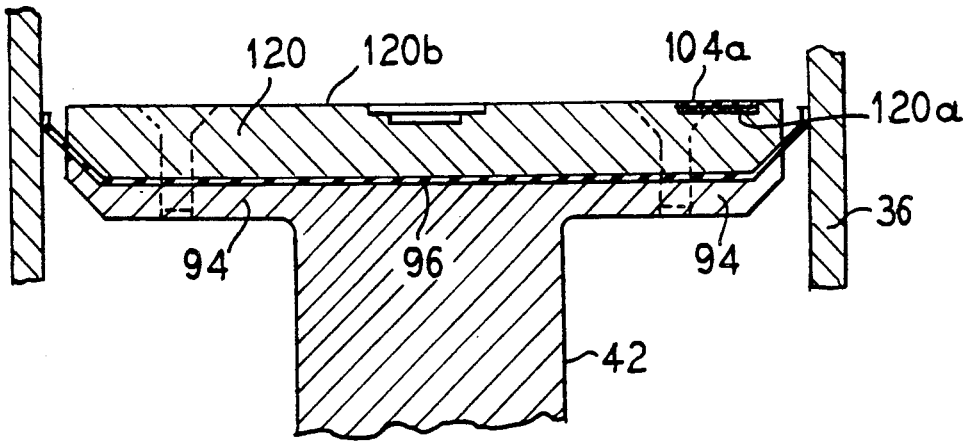
FIG. 5 is a fragmentary sectional view of an alternate embodiment of the piston and the wear shield.

FIG. 5 shows an alternate embodiment of the cap comprising an alternate cap 120. The alternate cap 120 is in all respect similar to the cap 98 except a recess **120*a* is provided in a facing surface 102*b* for acceptance of an alternative wear shield 104*a*. The alternate wear shield 104*a* can be somewhat thicker than the wear shield 104 and protrude from the recess 120*a* an appropriate distance to be substantially flush with the facing surface 102*b*. It can be advantageous to compressor operation for the facing surface 102*b* to be capable of approaching the head 20 as close as possible, a substantially flush wear shield provides this advantage. The recess 120*a* properly locates the wear shield 104*a* during assembly, insuring proper alignment between the inlet valve 24 and the wear shield 104*a* during operation. The wear shield 104*a* is secured in the recess 120*a*** with an adhesive.

Figure 6:
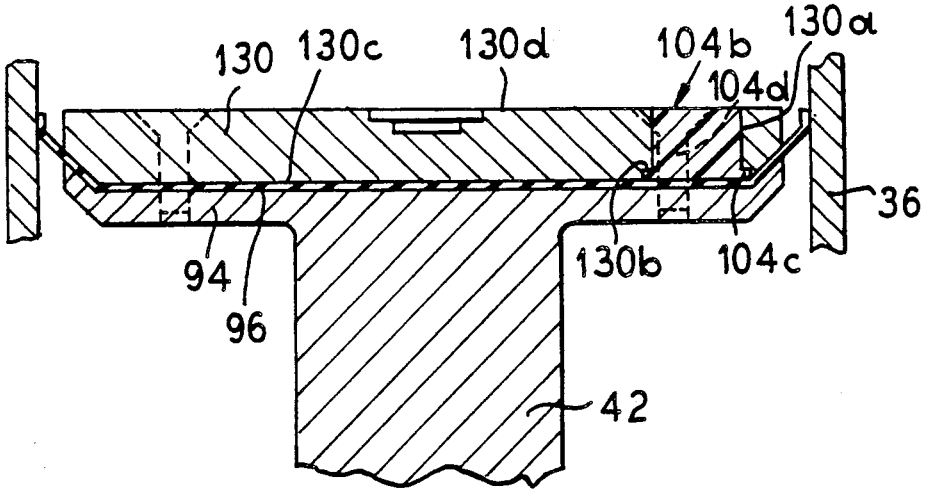
FIG. 6 is a fragmentary sectional view of a second alternate embodiment of the piston and the wear shield.

FIG. 6 shows a second alternate embodiment of the cap comprising a second cap 130. A second alternate embodiment of the wear shield comprises the second wear shield **104*b*. The second cap 130 provides an aperture 130*a* wherein resides the second wear shield 104*b*. The second wear shield 104*b* provides a flange portion 104*c* and a protruding portion 104*d*. The flange portion 104*c*** resides interior of a recessed or stepped portion 130*b*, the stepped portion 130*b* recessed inward from an interior surface 130*c* of the second cap 130. The protruding portion 104*d* protrudes from the stepped portion 130*b* toward the head 20 an appropriate distance to be substantially flush with an exterior surface 130*d* of the second cap 130. Thus, when the second cap 130 is secured to the rod flange 94, a flange portion 104*c* is captured between the second cap 130 and the rod flange 94, securing and precisely locating the second wear shield 104*b*. Thus, no adhesives or other fastening means would be necessary and the wear shield will be precisely and securely located.

Other means are also possible of securing the wear shield 104, 104*a*, 104*b* to the cap 98, 120, 130 and are encompassed in the present invention.

A similar alternate configuration (not shown) of the wear shield 104 would be to install the wear shield 104, 104*a*, 104*b* onto the head 20 directly opposite an inlet valve 24*a* located on the piston 44 opening toward the head 20. Such a location of the inlet valve 24*a* is clearly shown in U.S. Pat. No. 3,961,868. Any of the aforementioned means of attaching wear shields 104, 104*a* or 104*b* to the head 20 can be utilized.

Although other modifications and changes may be suggested by those skilled in the art, it is the intention of the inventors to embody within the patent warranted heron all changes and modifications as reasonably and property come within the scope of their contribution to the art.

I claim as my invention:

1. A gas compressor comprising:
a cylinder;
a piston residing interior of said cylinder and movable along an axis of said cylinder, with a surface facing interior of said cylinder;
a head connected to an end of said cylinder and facing interior of said cylinder;
a valve attached to one of said head and said piston and opening interior of said cylinder;
a wear shield secured to a respective other one of said piston and said head, opposite said valve, preventing repetitive contact from said valve onto said respective other one of said piston and said head during operation.

2. A gas compressor comprising:
a cylinder;
a piston residing interior of said cylinder and movable along an axis of said cylinder, with a surface facing interior of said cylinder;
a head connected to an end of said cylinder and facing interior of said cylinder;
a valve attached to said head and opening toward an interior of said cylinder;
a wear shield secured to said piston, opposite said valve, preventing repetitive contact from said valve onto said piston during operation.

3. A gas compressor according to claim 2, wherein said piston comprises a rod flange and a cap, said rod flange and said cap stacked and secured together in an orientation along the axis of said cylinder, with said cap between said head and said rod flange, said cap providing an aperture for receiving said wear shield;
and said wear shield comprises a flange portion which is held between said rod flange and said cap, and a protruding portion, connected to said flange portion, which protrudes from said flange portion toward said head interior of said aperture, and terminates substantially flush with said surface of said piston.

4. A gas compressor according to claim 3, wherein said wear shield is composed of a friction-reducing abrasion resistant material.

5. A gas compressor according to claim 4, wherein said wear shield is composed of plastic.

6. A gas compressor according to claim 5, wherein said wear shield is composed of ultra high molecular weight polyethylene.

7. A gas compressor according to claim 2, wherein said wear shield is sized to cover an area less than the area of said surface.

8. A gas compressor according to claim 7, wherein said wear shield is properly located on one of said piston and said head by an indented portion in one of said piston surface and said head.

9. A gas compressor comprising:
a cylinder;
a piston residing interior of said cylinder and movable along an axis of said cylinder, with a surface facing interior of said cylinder;
a head connected to an end of said cylinder and having a second surface facing interior of said cylinder;
a valve attached to one of said head and said piston and opening toward an interior of said cylinder;
a wear shield secured to one of said piston and said head by an adhesive, opposite said valve, preventing repetitive contact from said valve onto one of said piston and said head during operation.

10. A gas compressor according to claim 9, wherein said wear shield comprises a means for cushioning impact and reducing friction.

11. A gas compressor according to claim 9, wherein said wear shield comprises a friction-reducing material.

12. A gas compressor according to claim 11, wherein said wear shield is composed of plastic.

13. A gas compressor according to claim 12, wherein said wear shield is composed of ultra high molecular weight polyethylene.

14. A gas compressor comprising:
a cylinder;
a piston reciprocably mounted in said cylinder, with a face directed toward an interior of said cylinder;
a head connected to an end of said cylinder and having a face directed toward said piston face;
an inlet valve attached to said head and opening toward said piston face;
a wear shield secured to said piston face to prevent contact between said inlet valve and said piston face during operation of said gas compressor.

15. A gas compressor according to claim 14, wherein said wear shield is sized smaller than said piston face and is positioned to be engaged by said inlet valve.

16. A gas compressor according to claim 15, wherein said piston face has a recessed portion thereon for receipt of said wear shield.

17. A gas compressor according to claim 16, wherein said piston face and an exposed surface of said wear shield are substantially coplanar.

18. A gas compressor according to claim 14, wherein said wear shield is secured to said piston face by an adhesive.

* * * * *